United States Patent [19]

Price

[11] 4,238,815

[45] Dec. 9, 1980

[54] RECESSED LIGHT FIXTURE

[75] Inventor: Edison A. Price, New York, N.Y.

[73] Assignee: Edison Price, Incorporated, New York, N.Y.

[21] Appl. No.: 920,265

[22] Filed: Jun. 29, 1978

[51] Int. Cl.[3] ..... F21S 2/00

[52] U.S. Cl. ..... 362/218; 362/223; 362/260; 362/297; 362/345; 362/346; 362/373

[58] Field of Search ..... 362/217, 218, 223, 225, 362/260, 297, 307, 325, 330, 342, 345, 346, 364, 365, 366, 367, 373, 404, 406

[56] References Cited

U.S. PATENT DOCUMENTS

| | | | |
|---|---|---|---|
| 2,710,336 | 6/1955 | Jorn | 362/218 |
| 3,176,260 | 3/1965 | Pascucci | 362/217 |
| 3,181,450 | 5/1965 | Kruger | 362/365 |
| 3,415,018 | 12/1968 | Sutter | 362/223 |
| 3,675,006 | 7/1972 | Zafel | 362/223 |
| 3,737,656 | 6/1973 | Plana | 362/365 |
| 3,748,460 | 7/1973 | Price | 362/365 |

*Primary Examiner*—Donald P. Walsh
*Attorney, Agent, or Firm*—McAulay, Fields, Fisher, Goldstein & Nissen

[57] ABSTRACT

A recessed fluorescent light system includes a pair of saddle-shaped brackets having depending side legs resting on parallel bars of a hung ceiling structure, releasably locked thereto by bracket-carried lower spring latch members. A ballast and wire housing channel is coupled to the bracket top cross bars by bracket-mounted latch springs which also project through bracket transverse legs to define baffle assembly latch members. A horizontal plate reflector extends between and beyond the channel depending legs and is secured thereto. The plate includes depending longitudinal end flanges and inwardly spaced depending dimples. A light baffle assembly includes longitudinal upwardly and inwardly curved reflector plates terminating in horizontal flanges underlying and spaced from the side borders of the horizontal reflector by the dimples and spaced also from the depending flanges to delineate a sound attenuating tortuous elongated shallow air return passageway. The channel ends are closed by fluorescent bulb socket carrying depending side plates. The baffle assembly is releasably retained to the bracket by the baffle spring latch member engaging the upper flanges of the side baffle, and is connected at its upper corners by elongated bead chains to the bracket legs by way of the lower latch members. The sockets may be vertically adjustable.

26 Claims, 15 Drawing Figures

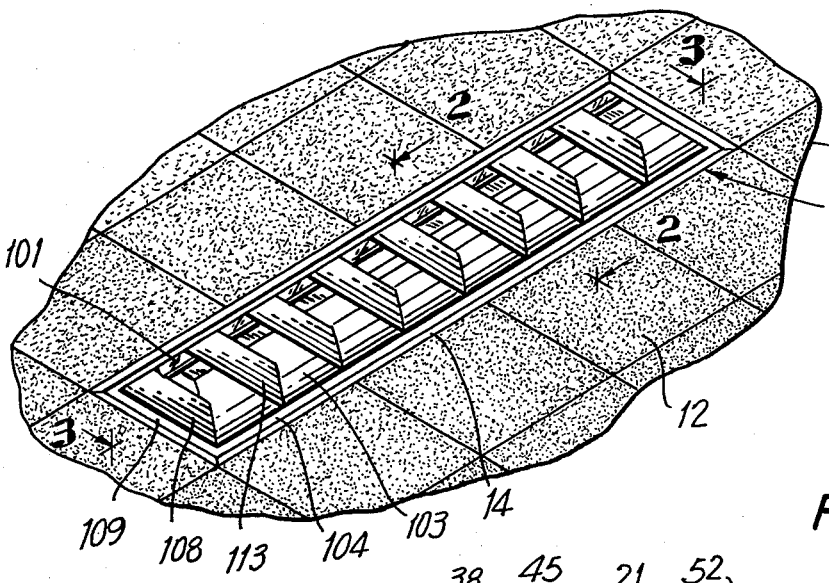
FIG. 1
FIG. 4
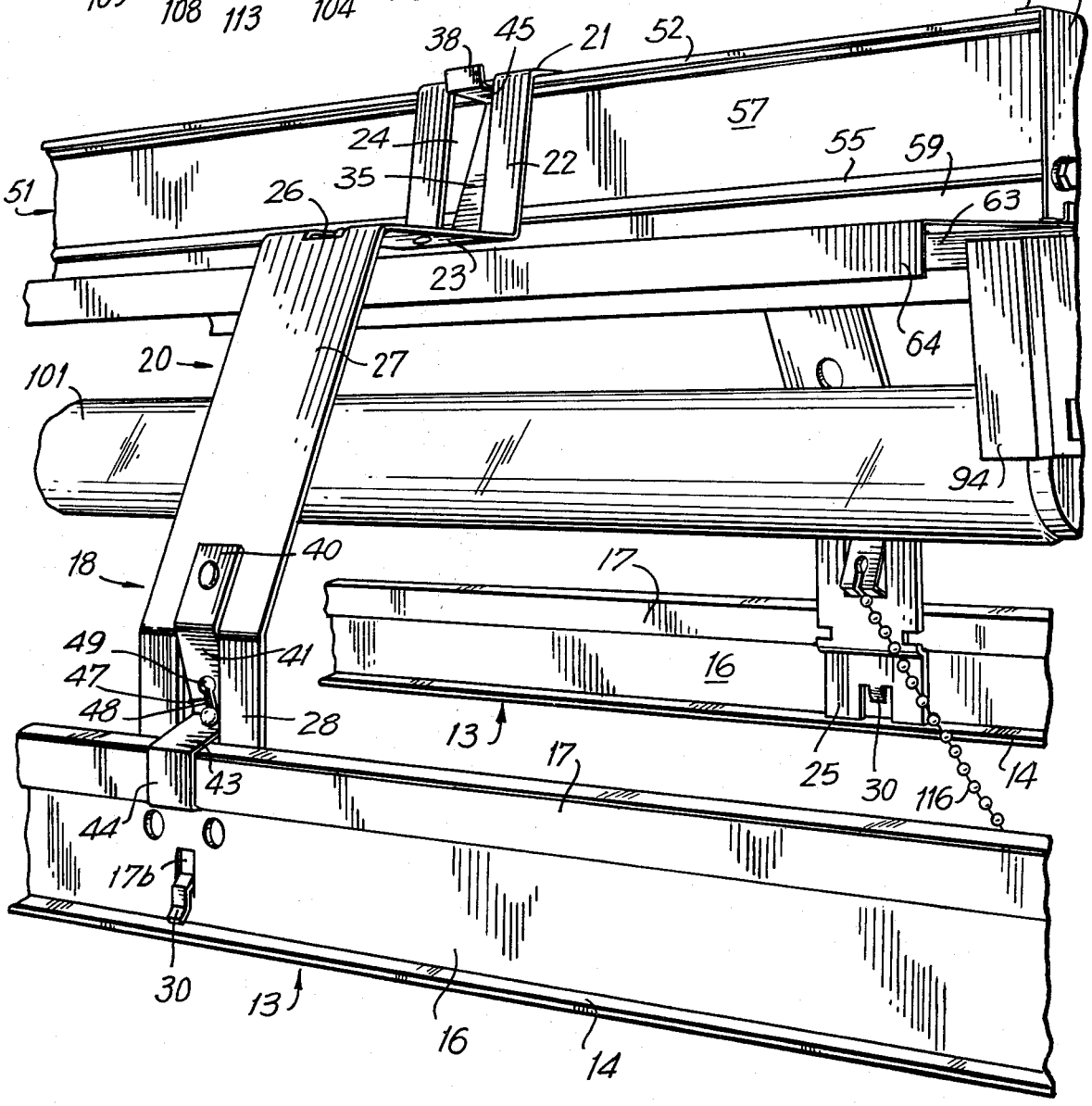

135
139
140
138
151
149
150
137
152
140
146
148
147
149
142
143
168
167
144
141
165
166
169
133
154
160
132
136
158
153
163
134
159
164
156
161
157
164

RECESSED LIGHT FIXTURE

BACKGROUND OF THE INVENTION

The present invention relates generally to improvements in illuminating devices, and it relates particularly to an improved recessed fluorescent light fixture mounted on a suspended or dropped ceiling structure.

A common and widespread practice in illuminating spaces, particularly commercial and industrial areas provided with dropped ceilings, is to mount the lighting fixtures, particularly fluorescent light fixtures provided with light reflectors and baffles, in corresponding openings in the ceiling with the bottom of the fixture approximately coplanar with the ceiling. Frequently, in such installations, the recessed light fixture is constructed to provide openings which permit the flow of air between the illuminated space and the space above the dropped ceiling to permit or contribute to the return flow of air in air conditioning systems.

The conventional and heretofore proposed recessed lighting fixtures of the above type possess numerous drawbacks and disadvantages. Important among these drawbacks is the high degree of sound transmission between the illuminated area and the space above the ceiling. As a consequence, sound is transmitted between different parts of an area having a common ceiling space of intercommunicating ceiling spaces so that quietness and privacy of these separate parts even where the illuminated area with a common ceiling is partitioned or otherwise subdivided simply are not achieved. Noises, as speech, music, or other sounds emanating from one area, are audible to a substantial extent in other areas and this, of course, is highly annoying and undesirable. In addition, the conventional recessed fluorescent light fixture is often difficult to assemble, install, service, and maintain, is usually of little versatility and adaptability, and otherwise leaves much to be desired.

SUMMARY OF THE INVENTION

It is a principal object of the present invention to provide an improved illumination device.

Another object of the present invention is to provide an improved recessed light fixture.

Still another object of the present invention is to provide an improved dropped ceiling structure-supported recessed fluorescent light fixture.

A further object of the present invention is to provide a recessed fluorescent light fixture which, while affording a passageway for the flow of air, provides a minimum of sound transmission ability therethrough.

Still a further object of the present invention is to provide an improved recessed fluorescent light fixture which is inexpensive, rugged, reliable, efficient, easy and convenient to assemble and disassemble, install, service, and maintain, and of great versatility and adaptability.

The above and other objects of the present invention will become apparent from a reading of the following description taken in conjunction with the accompanying drawings which illustrate preferred embodiments thereof.

In a sense, the present invention contemplates the provision of a recessed fluorescent light fixture comprising a longitudinally extending reflector assembly including upper and side interior reflector faces delineating an interior space and a bottom opening and means defining a sound attenuating narrow elongated air flow passageway from said interior face to the exterior thereof, above said bottom opening and through the reflector assembly, and extending along the length of the reflector assembly, and means for supporting a lamp within said interior space. Advantageously, the reflector assembly includes a transverse top reflector supported by means of brackets on a dropped ceiling support structure and a subassembly including longitudinally extending side reflectors and transversely extending lower light baffles, the side reflectors terminating at their tops in horizontal flanges which confront the side borders of the top reflector and are parallel thereto and spaced therefrom by dimples depending from the top reflector. The top reflector is provided also with depending side flanges spaced from the ends of the top flanges of the side reflector, the confronting faces of the side reflector flanges and the top reflector defining at least part of the sound attenuating air flow passageway.

Further, the light fixture is of an improved structure including a pair of longitudinally spaced saddle-shaped brackets the depending side legs of which rest in spaced beams of the ceiling structure and include bottom positioning tabs and leaf spring latch members which releasably engage the respective beams to restrict the upward movement of the brackets. A longitudinally extending inverted channel shaped housing extends between the brackets and is located in arches formed in the upper cross-pieces thereof, the top reflector covering the bottom opening of the housing and being separably attached thereto. The reflector assembly extends between the brackets below the housing and leaf spring latch members and is located on opposite sides of the brackets, and each includes an end portion releasably locking the housing and top reflector to a respective bracket and an opposite end portion releasably locking the reflector baffle subassembly to the reflector.

The subassembly is connected by long chains to the brackets so that upon release thereof for serving of the fixture it is suspended from the brackets. The improved fixture, while providing a passageway sufficient for the flow of circulating air, highly attenuates the transmission of sound and thus functions as a sound barrier. Moreover, the fixture is simple and rugged, easy and convenient to assemble and disassemble, install, service and maintain, and is of great versatility and adaptability.

BRIEF DESCRIPTION OF THE DRAWINGS

FIG. 1 is a bottom perspective view of a recessed light fixture embodying the present invention, shown in installed condition;

FIG. 4 is a fragmentary perspective view thereof with the baffle-reflector assembly in dropped condition;

DESCRIPTION OF THE PREFERRED EMBODIMENTS

Figure 2:
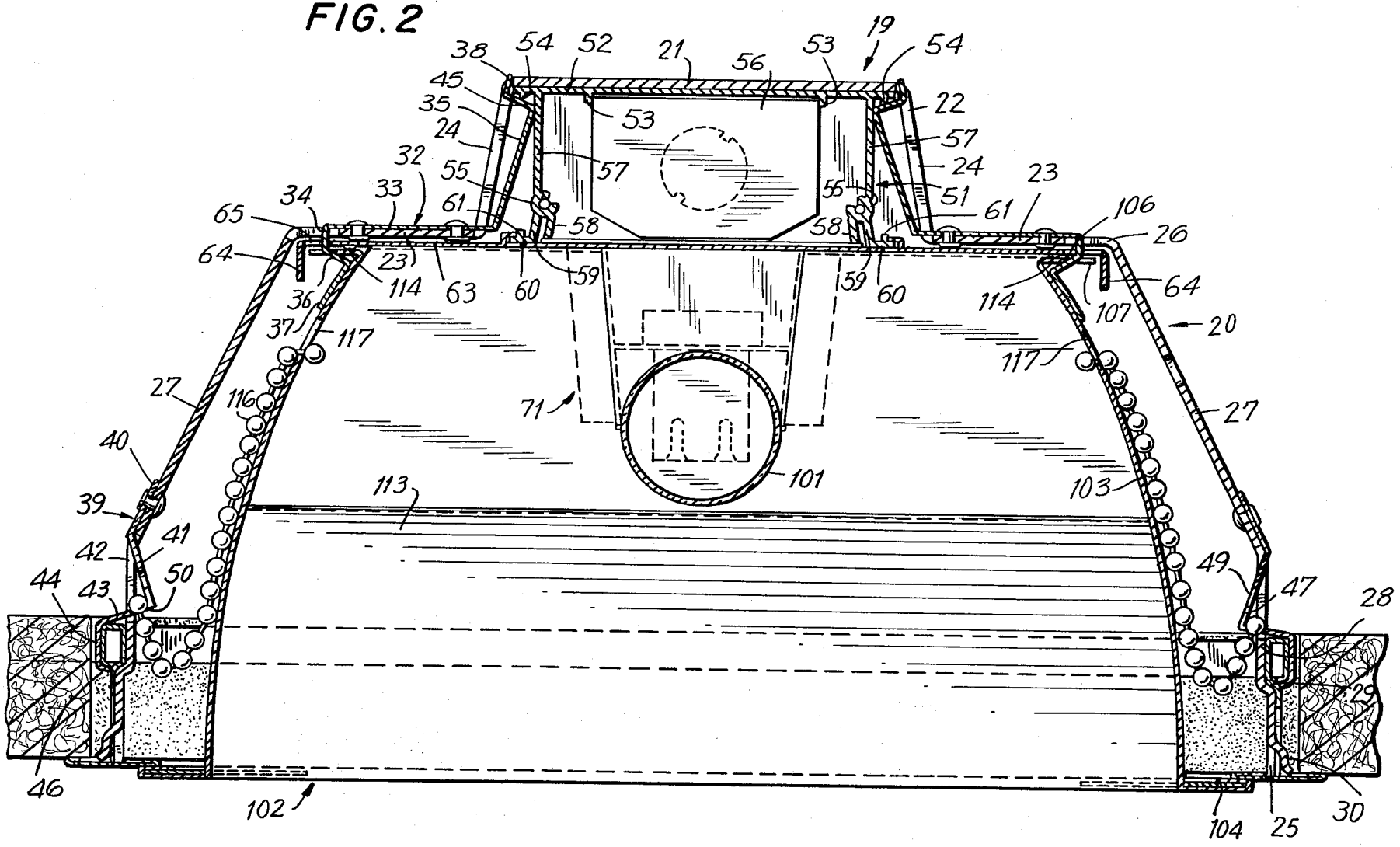
FIG. 2 is an enlarged sectional view taken along line 2—2 in FIG. 1.

Referring now to the drawings and particularly FIGS. 1 to 12 thereof which illustrate a preferred embodiment of the present invention, reference numeral 10 generally designates the improved light fixture which is shown recessed in a dropped or hung ceiling 11 of generally known construction, which includes an overhead suspended structure supporting ceiling tile 12 in the known manner and the light fixture 10 in a recessed position. The tile and fixture supporting structure includes transversely spaced parallel longitudinally extending beams 13 of inverted T-shape transverse cross section.

Each beam 13 includes a bottom cross web 14 and a medial vertical web 16 terminating at its top in an enlarged integrally formed hollow rectangular or box section 17. Formed in vertical web 16 are regularly longitudinally spaced narrow rectangular positioning openings 17*b* located above the cross web 14.

The light fixture assembly includes a set of at least two longitudinally-spaced saddle-shaped brackets 18 for mounting light fixture 10 in recessed registry with a correspondingly shaped opening in ceiling 11 left by the omission or removal of respective ceiling tiles 12. Each bracket 18 is formed of a steel strip and includes an upper cross member 19 and depending side legs 20. The cross member 19 includes an upper medial cross arm 21 provided at its ends with downwardly diverging depending side arms 22 terminating at their bottoms in outwardly directed coplanar horizontal side arms 23. A longitudinal medial slot 24 is formed in each side arm 22 and a longitudinal medial slot 26 is formed in the outer end of each side arm 23.

Each bracket side leg 20 includes a downwardly outwardly inclined upper section 27 and a vertical lower section 28. Each lower leg section 28 is provided between the top and bottom of its outer face with an upwardly facing transverse shoulder 29, and has formed at its bottom a medial longitudinal tongue 30 which is outwardly and downwardly directed and divides the free end of the bottom section into a pair of spaced wide depending legs 25.

A dual purpose first locking member 32 is mounted in each side arm 23 and is formed of a leaf or resilient steel spring band which includes a medial arm 33 overlying and extending along and riveted to a respective side arm 23. The outer end of each arm 33 is provided with a depending portion 34 projecting through opening 26 and having an inwardly downwardly inclined arm 36 which terminates in a downwardly outwardly inclined resilient latch arm 37. The inner end of arm 33 projects through the bottom of slot 24 and joins a sharply upwardly and inwardly inclined long arm 35 located inwardly of bracket arms 22 and provided at its upper end with a short upwardly and outwardly inclined latch arm 45 projecting outwardly through slot 24 and terminating in an upwardly projecting stop arm 38 bearing on the side edge of cross arm 21.

A second locking member 39 is mounted to the lower part of each bracket leg 20 and is likewise formed of leaf spring steel, and includes an upper arm 40 overlying and riveted to the lower part of a respective side leg section 27 and provided at its lower end with an inwardly and downwardly inclined arm 41 projecting through a medial longitudinal slot 42 in the upper part of lower leg section 29. Joining the lower end of arm 41 is a downwardly and outwardly inclined arm 43 projecting outwardly through the bottom of slot 42 and joining at its outer end a depending vertical portion 44 which terminates in an inwardly projecting flange 46.

In the installed condition of lighting fixture 10, brackets 18 extend between a pair of beams 13 with the bifurcated bottom legs 25 of the bracket resting on the inside sections of the beam cross web 14, and extending along the inside faces of vertical webs 16 and the coupling tongues 30 engaging respective positioning openings 17. The bracket shoulders 29 engage the inside under faces of enlarged sections 17*b* of the beam vertical web, and the spring latch flanges releasably engage the outside under faces of enlarged sections 17 to releasably lock brackets 18 to beams 13 and prevent any relative vertical longitudinal or transverse movement thereof. The brackets are easily and rapidly positioned on and locked to the beams merely by spreading the spring latches outwardly, lowering the brackets onto beam cross webs 14, bringing tongues 30 into engagement with openings 17 and the shoulders into engagement with enlarged sections 17, and then releasing latch springs 39 to return the flanges to underlying engagement with the enlarged sections 17 of the beam web.

A ball chain-engaging opening 47 is formed in each latch spring 39 proximate the junction of the arms 41 and 43 thereof. Each opening 47 includes a longitudinal keyhole slot 48 formed in a respective arm 41 and having the enlarged circular opening 49 at the top thereof which communicates with an enlarged smaller diameter opening 50 in the respective arm 43. Openings 43 and 50 are respectively larger and smaller than the balls of the associated ball chain, as will be hereinafter identified.

An inverted channel shaped housing and support member 51 extends between and beyond spaced brackets 20 and registers with the arches defined by the upper bracket arms 21 and 22. Housing member 51 is formed of an extrusion and includes a top horizontal cross web 52 provided with outer depending ridges 54 spaced shortly inwardly of the outer edges of cross web 52, inner ridges 53 engaging between them a ballast 54. Also depending from cross web 52 shortly inwardly of outer ridges 54 are vertical parallel channel resiliently flexible side webs 57 which terminate at their bottoms in upwardly and inwardly open longitudinal C-shaped channels 55 having formed therewith depending downwardly and outwardly inclined inner flanges 58 and outer flanges 59 parallel to and spaced outwardly of flanges 58. Flanges 59 terminate at their bottoms in coplanar outwardly directed horizontal flanges 60 below the levels of the bottoms of flanges 58 and having ridges 61 formed on their top faces between their side edges.

In the bracket-supported condition of housing channel 51 top cross web 52 engages the under faces of the bracket cross arms 21 and extends for the widths thereof, and channel 51 is releasably locked in its assembled condition by spring arms 45 engaging the bottoms of ridges 54 and the junctions of spring arms 35 and 45 bearing on the upper parts of channel side webs 57.

A top reflector member 63 in the form of a flat rectangular plate with a reflector under face is mounted to the bottom opening of channel housing 51 and extends for the full length thereof and for substantially the full distance between the outer ends of bracket horizontal cross arms 23. The reflecting plate 63 terminates at the longitudinal side edges in depending flanges 64 and is provided with openings 65 in its side borders through which spring arms 34 project and are transversely movable. Recesses are formed in the medial end borders of plate 63 matingly to accomodate the lamp socket support assemblies, as will be hereinafter described.

In order to lock reflector plate 63 releasably to housing channel 51 a plurality of longitudinally aligned transversely spaced securing tabs 67 are integrally formed with reflector plate 63. Each securing tab includes a longitudinally extending vertical wall 68 terminating at its top in an inwardly directed horizontal flange 68 having a longitudinal rectangular tool-receiving recess 70 medially formed on its free edge. In the mounted condition of reflector plate 63 securing tab flanges 69 engage the top faces of channel flanges 60 with their free edges abutting ridges 61. The free ends of flanges 60 are accessible through recesses 70 so that a screw driver or similar tool can be inserted between the end face of a flange 60 and the base of a recess 70 to facilitate the inward flexing of web 57 thereby to make possible the coupling and uncoupling of securing tabs 67 to and with channel flanges 60. Tool-accomodating recesses for performing the above function may be otherwise provided for, for example, in the form of tool-receiving openings in plate 63 proximate to and longitudinally offset from respective securing tabs 67.

Figure 3:
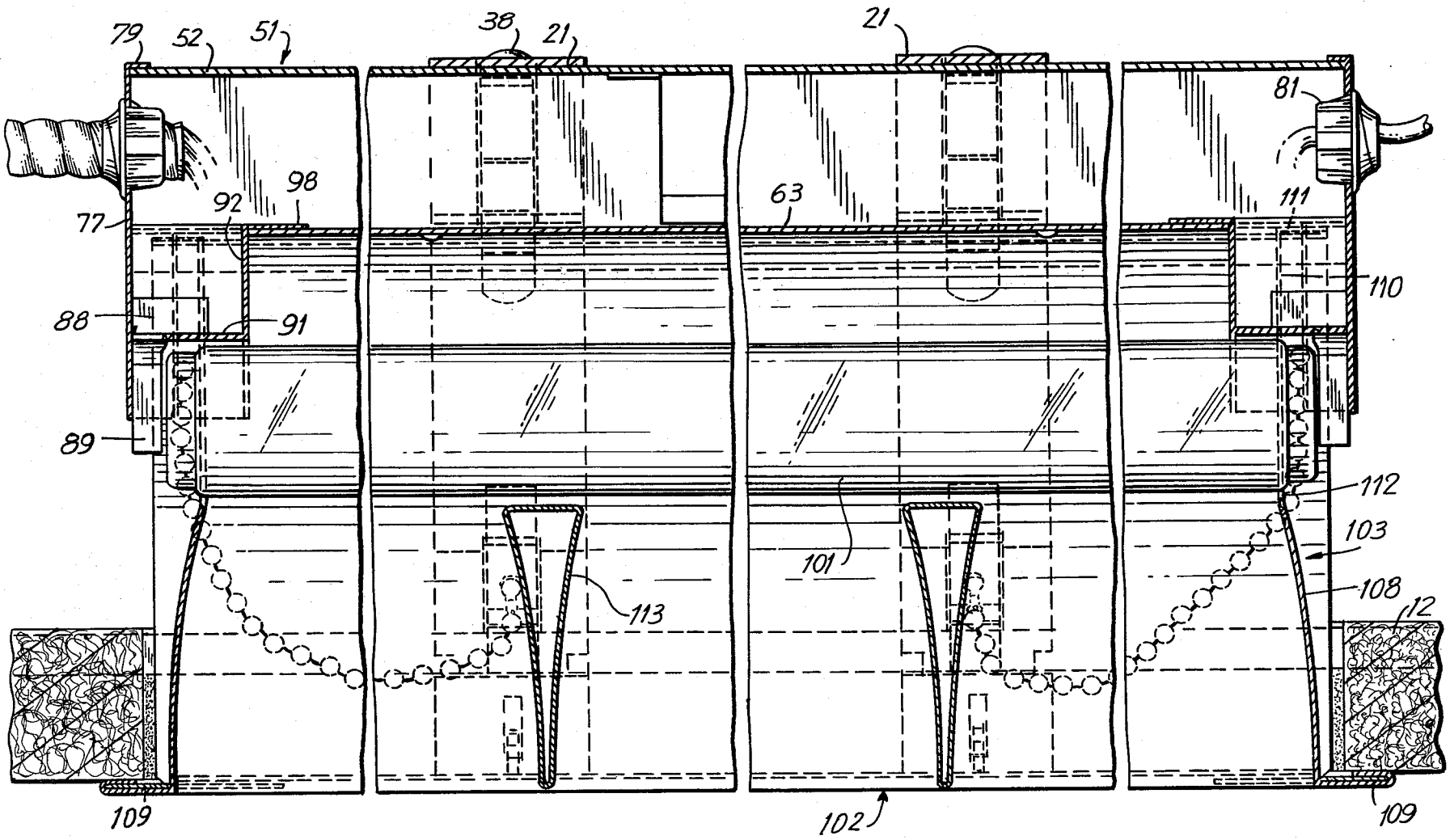
FIG. 3 is an enlarged sectional view taken along line 3—3 in FIG. 1.
Figure 5:
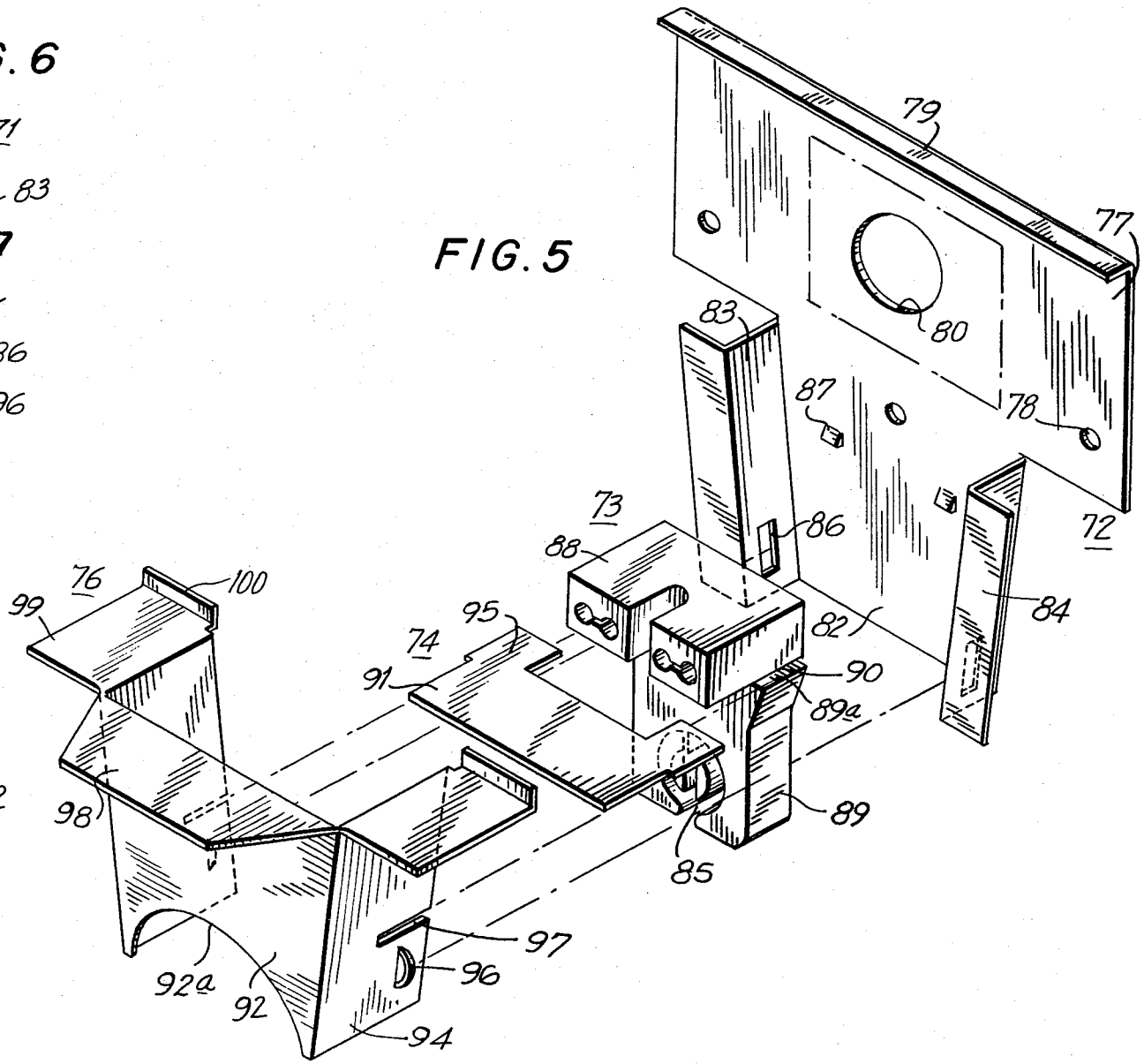
FIG. 5 is an exploded perspective view of the lamp socket and mount assembly.
Figure 6:
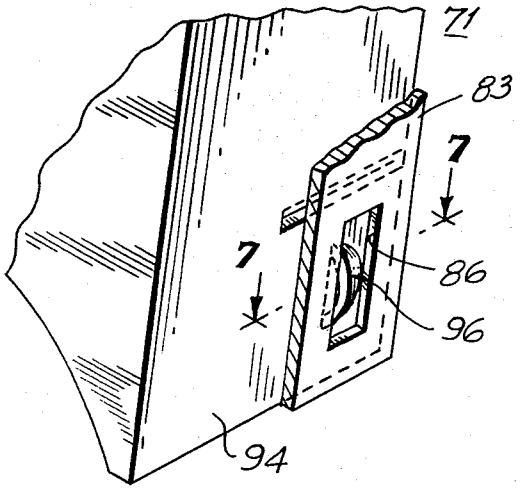
FIG. 6 is an enlarged fragmentary detailed perspective view of the lamp socket and mount in assembled condition.
Figure 7:
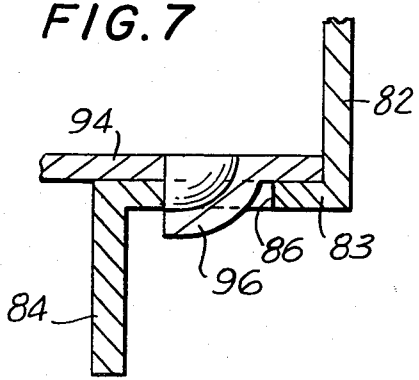
FIG. 7 is a sectional view taken along line 7—7 in FIG. 6.
Figure 8:
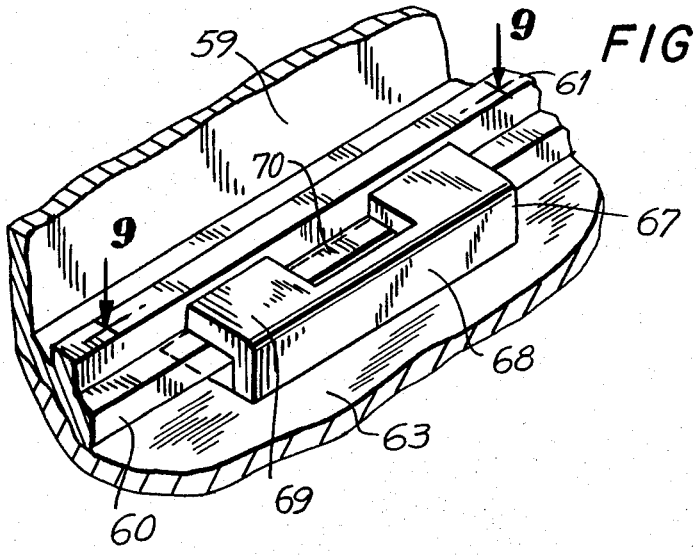
FIG. 8 is a fragmentary enlarged perspective view showing the coupling between the top reflector and the housing channel.
Figure 9:
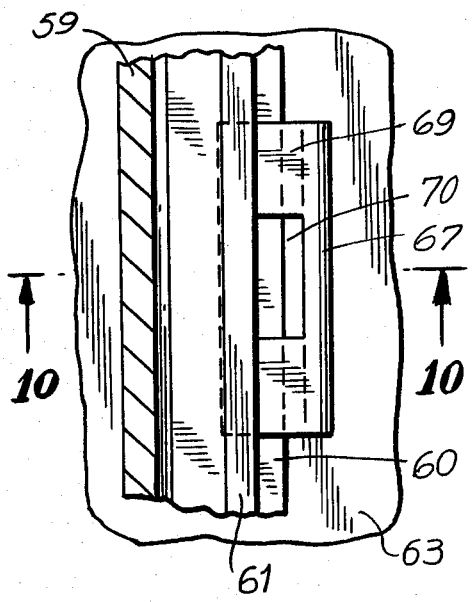
FIG. 9 is a sectional view taken along line 9—9 in FIG. 8.
Figure 11:
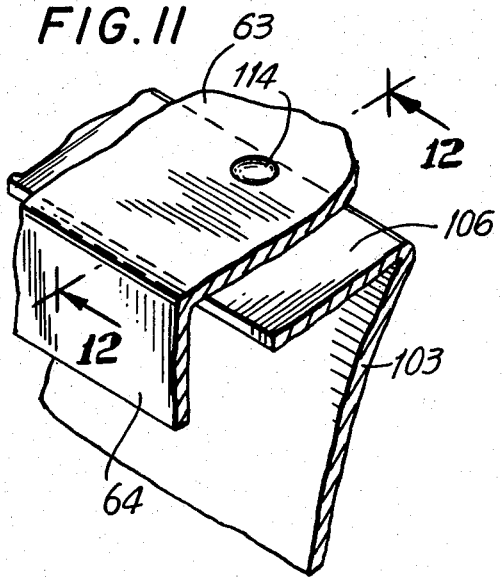
FIG. 11 is a fragmentary enlarged perspective view of the interface between the top and bottom reflector members.
Figure 10:
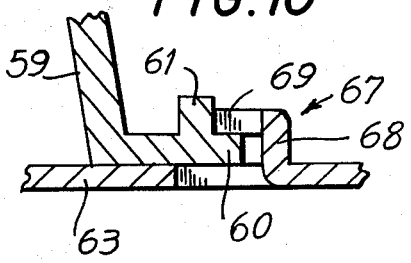
FIG. 10 is a sectional view taken along line 10—10 in FIG. 9.
Figure 12:
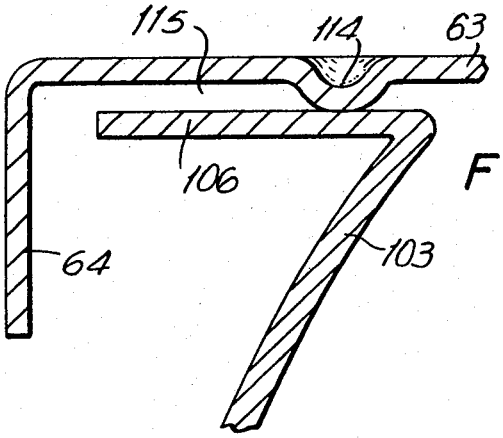
FIG. 12 is a sectional view taken along line 12—12 in FIG. 11.

A fluorescent bulb socket and socket support assembly 71 is located and closes each end of housing channel 51 and depends below reflector plate 63. The assembly 71, as best seen in FIGS. 5 to 7, includes a main mounting and cover plate, a fluorescent lamp socket 73, a socket support plate 74 and a cover shell 76. The mounting plate 72 includes a rectangular upper section secured to and closing an end of housing channel 51 by screws engaging C-shaped channels 55 and holes in plate section 77 and aligned with channels 55. Formed along the top edge of section 77 is an inwardly directed flange 79 which overlies the top web of channel 21, and a circular opening 80 is centrally located in section 77 to engage a flexible conduit coupling 81 (FIG. 3). Medially depending from plate section 77 is a trapezoidal coplanar section 82 with downwardly converging side edges along which are formed inwardly longitudinally directed flanges 83 terminating in outwardly transversely directed coplanar flanges 84. Located in the lower part of flanges 83 are longitudinally extending coupling slots 86; formed in section 82 below the top edge thereof are a pair of transversely spaced inwardly directed abutment projections 87 with downwardly facing shoulders.

Socket 73 is of broadly known construction and includes an integral body provided with an upper horizontal block section 88 and a vertical block section 89 depending from the rear of upper section 88 and having the conventionally shaped socket 85 housing the socket electrodes. The upper part of lower section 89 flares upwardly and outwardly and terminates in a top shoulder **89*a* which delineates with the under face of upper section 88 longitudinal side grooves 90. Plate 74 includes an inner cross web 91 and outwardly projecting parallel coplanar side legs 95 which straddle socket member 73 and engages opposite grooves 90. Shell cover 76 includes a vertical trapezoidal inner wall 92 having a semi-circular recess 92*a* in its bottom edge and corresponding to wall section 82. Projecting outwardly from the side edges of wall 92 are rectangular side walls 94 each having proximate its lower outer corner a transversely outwardly directed curved coupling projection 96 with an outer cam surface. A pair of horizontal parallel slots 97 formed in side walls 94 engage the outer longitudinal borders of plate side arms 95, plate 91 extending between side walls 94 and the body lower section 89 depending below inner wall 92 with the lamp socket portion thereof being fully exposed through and below bottom recess 92*a* in inner wall 92**.

Front wall 92 is provided at its top with an inwardly projecting trapezoidal horizontal top wall 98 and side walls 94 are provided at their tops with transversely outwardly projecting horizontal side walls 99 terminating at their outer transverse edges in upwardly projecting flanges 100. In the assembled condition of socket assembly 71 the socket-carrying housing shell projects between walls 83 the inside faces of which are engaged by shell side walls 94 and locked thereto by the intercoupling of projections 96 with respective openings 86, projections 87 overlying the border of socket upper section 88. Shell 76 engages a corresponding medial recess in the respective end border of reflector plate 63 the underface of which is engaged by the top edges of walls 83 and 84, shell top walls 98 and 99 being superimposed on reflector plate 63 with upwardly directed flanges 100 engaging the bottom outer border of plate section 77. A conventional fluorescent lamp 101 extends between and is releasably supported by sockets 85 in the known manner.

A reflector baffle assembly 102 extends between and beyond brackets 20 and is releasably supported thereby by means of resilient spring latch arms 36 in a position projecting above the under face of beam cross web 14 and engaging the opening in ceiling 11. Assembly 102 includes upwardly converging longitudinally extending reflector side walls 103 having formed along their bottom edges outwardly projecting horizontal flanges 104 and having along their upper edges outwardly directed coplanar horizontal flanges 106. Longitudinally spaced latch engaging rectangular recesses 107 are formed in the outer edges of flanges 106 and are positioned to engage corresponding latch spring arms 36. The end borders of opposite side reflectors 103 joined by transverse end walls including upwardly converging lower sections 108 having at their bottoms outwardly directed horizontal flanges 109 similar to and coplanar with flanges 104 are joined to the ends thereof. Extending upwardly from end wall lower sections 108 are vertical sections 110 which terminate in outwardly directed horizontal flanges 111 abutting the under faces of the end borders of reflector plate 63 and slightly upwardly offset from side reflector flanges 106. A vertical recess 112 is medially formed for substantially the full height of each wall section 110 and is shaped to accomodate snugly a registering socket assembly and provide access by the ends of lamp 101 to sockets 85 to permit the installation and replacement of a lamp 101 while providing a barrier between the interior and exterior upper spaces of fixture 10.

Extending transversely between and suitably secured to the lower portions of side reflectors 103 are longitudinally spaced parallel transverse cross baffles 113 of hollow V-shaped configuration. The top faces of baffles 113 are positioned directly below lamp 101 and the bottom apices thereof are coplanar with the frame defined by flanges 104, 109.

In accordance with the present invention, longitudinally separated depending spacer bumps 114 are formed in the outer side borders of top reflector plate 63 and engage the top faces of flanges 106 proximate their inner edges thereby positively to space the flanges 106 which terminate short of flanges 64 below the side borders of reflector plate 63 thereby to define therewith outwardly directed narrow relatively long air flow passageways 115 which extend for substantially the full length of the top reflector plate while the passageways 115 permit a suitable air flow consequent to the normal pressure differential between its opposite ends. These are the only significant openings between the inner and exterior spaces separated by the light fixture 10 and they function to attenuate considerably the passage or transmission of sound therethrough. Depending flanges 64 spaced from the full edges of flanges 106 further contribute to the attenuation of the transmitted sound.

In accordance with an embodiment of the present invention bumpings 114, four of which are located along each side of reflector plate 63, are about 0.05" deep, as is the height of passageway 115, flange 106 is about 0.5" wide to define the length of passageway 115 in the direction of air flow, and the length of flange 106 is about 47.5" to define the width of passageway 115. Accordingly, the cross area of the flow through the opposite passageways 115 which provide the only significant communication between the spaces on opposite sides of the light fixture 10 is approximately 4.75 square inches, highly suitable for the required air flow at the usual pressure differential, while the narrowness and length of the passageways 115 highly attentuate the transmission of sound therethrough.

Elongated bead chains 116 releasably engage at respective first ends thereof in openings 47 in respective joined spring arms 41 and 43 and at their opposite ends in vertical keyhole slots 117 formed proximate the upper corners of side reflectors 103.

In the normal installed condition of baffle reflector assembly 102 latch spring arms 36 register with respective recesses 107 in flanges 106, and engage the bottom edges of the bases of recesses 107 releasably to retain the flanges 106 in engagement with bumps 114 and parallel to reflector plate 63, and spring arms 37 bear on the upper outside faces of side reflectors 103 to position laterally the assembly 102. Furthermore, bottom flanges 104 and 109 engage the under face of ceiling 11 bordering the fixture-receiving opening therein. As will be readily appreciated, bumpings as 114 may be formed as desired in borders 65 of the first reflector to extend downwardly and against flanges 106, instead of the arrangement illustrated.

To obtain access to lamp 101 for replacement or servicing the reflector baffle assembly is manually drawn or pulled downwardly and thus disengaged from the opposite spring arms 36 and the respective resilient flange recesses 107 to permit dropping the corresponding side of reflector baffle assembly and subsequent disengagement from the other spring arms 36. The entire reflector baffle assembly is then lowered and suspended by chains 116. If desired, one or both pairs of chains 116 may be uncoupled from openings 47 to suspend further or entirely to detach the assembly 102. Not only is access to lamp 101 now available, but channel housing 51 and reflector plate 63 may be separated from brackets 20 against the influence of spring arms 35 and 45, and reflector plate 63 may be separated from housing channel 51 by deflecting channel arms 57 inwardly, as earlier described. Fixture 10 may be reassembled and installed in a reverse manner, spring arms 35 and 37 functioning as cams to facilitate the spreading thereof under the influence of upwardly moving channel webs 52 and bases of recesses 107.

Figure 13:
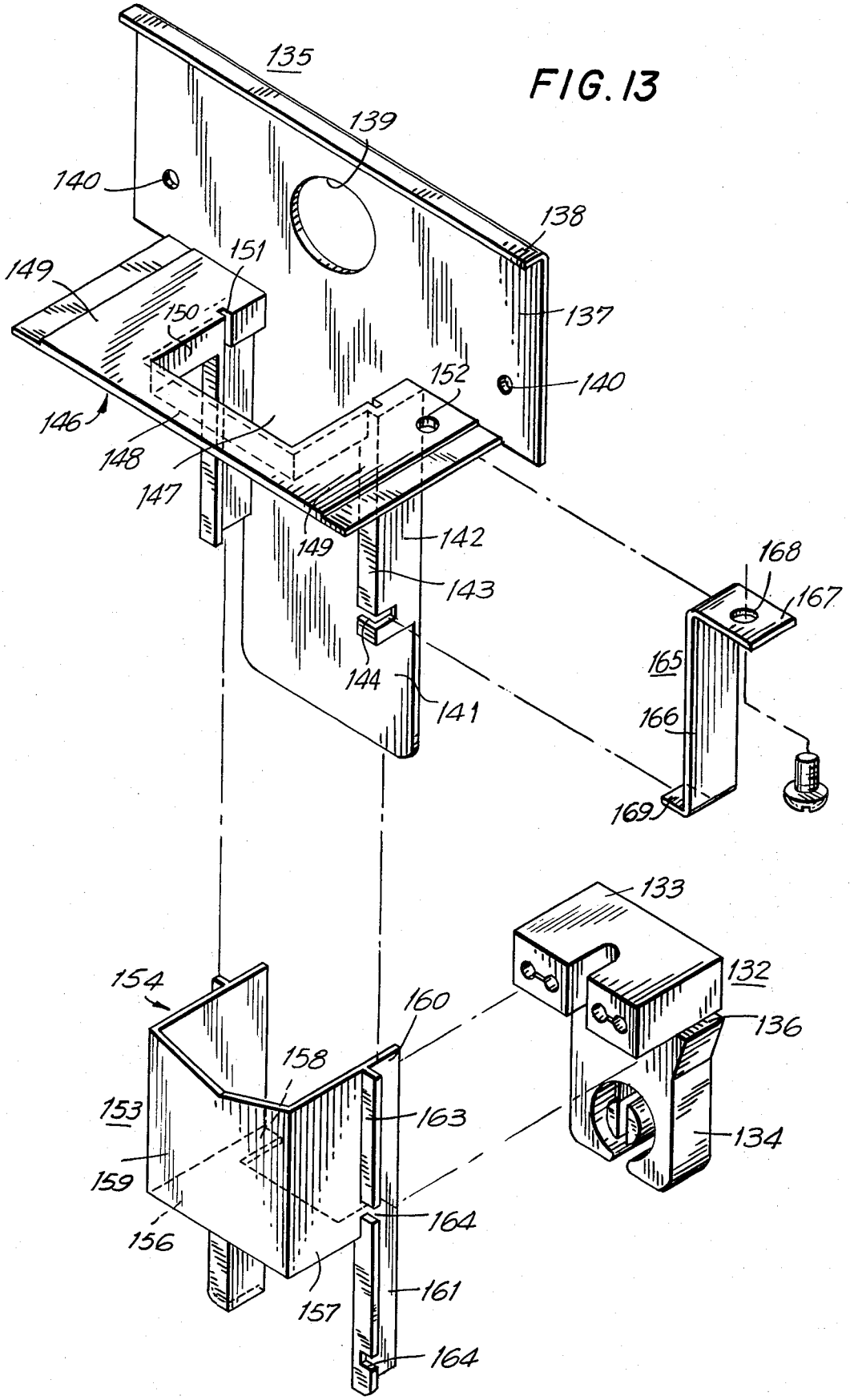
FIG. 13 is a view similar to FIG. 5 of a modified lamp socket and mount.
Figure 14:
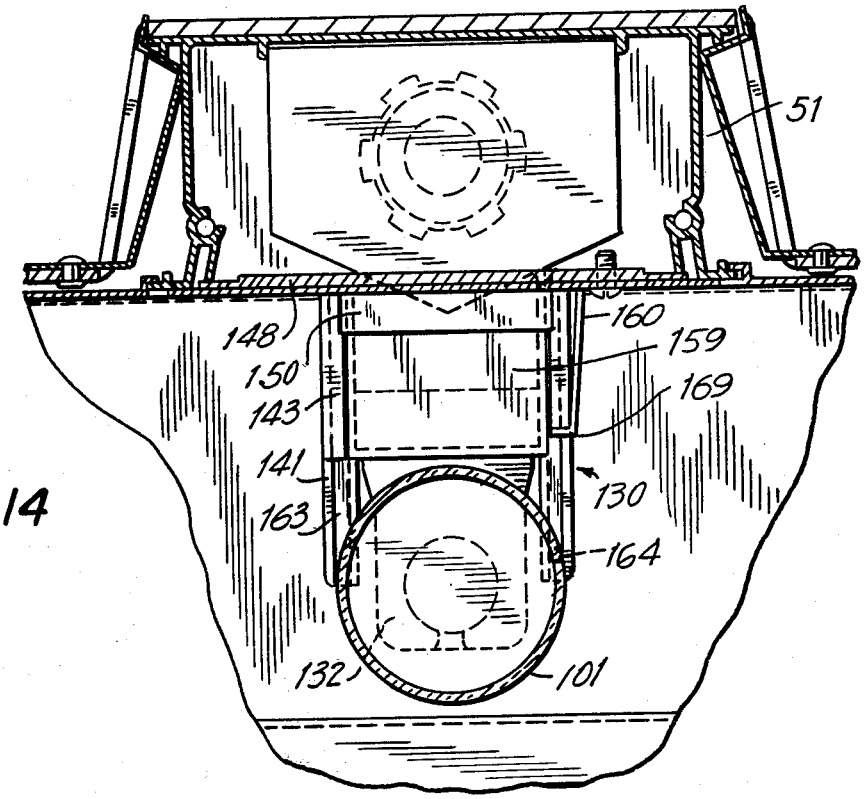
FIG. 14 is a fragmentary transverse sectional view of a fixture similar to that of FIGS. 1 to 13, but with the socket mount of FIG. 13, the socket being shown in its lower adjusted position.
Figure 15:
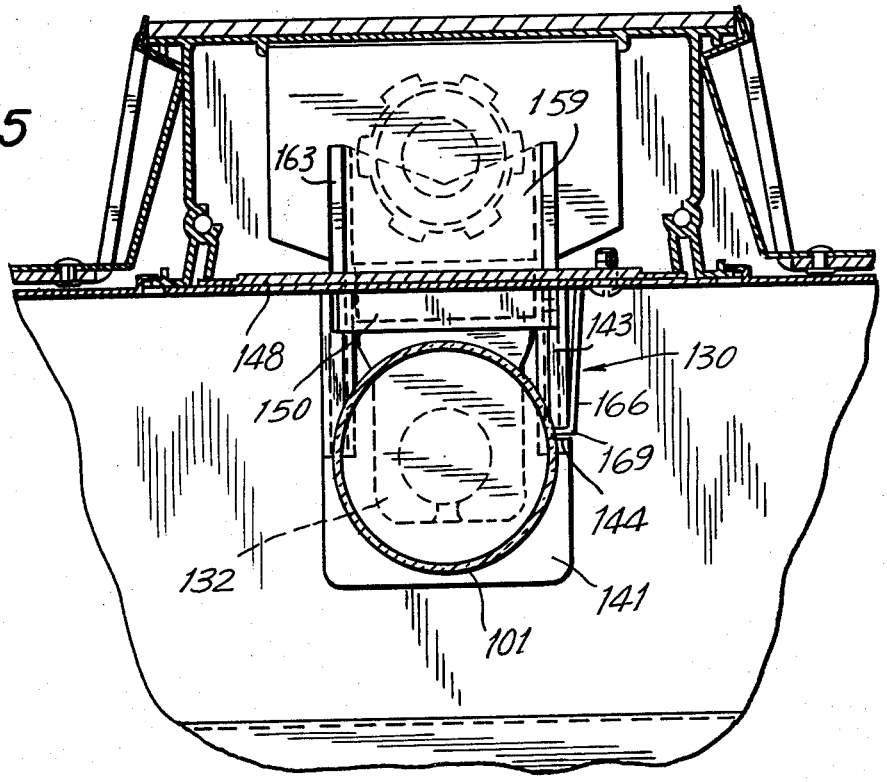
FIG. 15 is a view similar to FIG. 14 but with the socket shown in its upper adjusted position.

In FIGS. 13 to 15 of the drawings there is illustrated another embodiment of the present invention which differs from that first described only in the construction of the socket mounting assembly, and the change in configuration of the recesses in the reflector baffle assembly end walls to accomodate the modified socket mounting assembly. In all other ways the embodiment shown in FIGS. 13 to 15 is similar to that first described.

Specifically, the modified socket mounting assembly is designated by reference numeral 130 and it vertically adjustably supports a socket member 132 which is of the same construction as socket member 73 earlier described, and includes upper and lower sections 133 and 134 between which are longitudinal grooves 136. The assembly 130 comprises a mount 135 including an outer upper vertical rectangular plate section 137 terminating at its top in an inwardly directed flange 138 and provided with a conduit coupling receiving opening 139 and openings 140 for receiving screws securing section 137 to an end of housing channel 51. Depending from section 137 is an integrally formed coplanar rectangular lower plate section 141. Formed along the upper side edges of section 141 are inwardly projecting vertical side walls 142 terminating in coplanar transverse flanges 143 directed towards each other, a horizontal slot 144 being formed in one of the flanges 143 proximate its lower end and extending to and along the adjacent side wall 142.

Integrally formed with the bottom edge of section 137 and projecting inwardly and being of less width thereof is a horizontal medial rectangular frame 146 having a medial rectangular guide opening 147 delineated by cross leg 148, side legs 149 and plate section 141. Depending from the opening delineating edges of frame 146 are vertical side and inner flanges 150, side flanges 150 being coplanar with the free edges of flanges 143 and having vertical grooves 151 wherein aligned with the faces of flanges 143 directed towards section 141. A tapped opening 152 is formed in right hand leg 149, as seen in FIG. 13, proximate section 137.

A socket member carrying vertically adjustable support member 153 includes a carriage member 154 having a rectangular bottom wall 156 within which is a medial rectangular recess 157 in its rear edge flanked by coplanar side legs 158. Front and side walls 159 and 160 project upwardly from the corresponding edges of bottom wall 156, vertical legs 161 depending from and being coplanar with the rear borders of side walls 160. Formed along the front edges of legs 161 and extending linearly along the outer faces of side walls 160 are outwardly directed vertical flanges 163, the right hand flange having a plurality of longitudinally spaced notches 164 formed therein.

The socket member 132 is mounted on carriage member 154, the upper section thereof resting on bottom wall 156, socket member grooves 136 being engaged by side legs 158 and the lower socket section depending from bottom wall 156 with its rear face coplanar with the carriage near edges. Socket-carrying member 153 is slidably supported by mount 135, the carriage 154 and flanges 163 slidably engaging grooves 151 with the confronting faces of the flanges 144 and 163 slidably abutting, and the rear edges of side walls 160 and legs 161 slidably related with the confronting face of plate sections 137 and 141.

In order to lock socket carrying carriage 154 releasably in a vertically adjusted position there is provided a latch member 165 formed of resilient metal or leaf spring strip and including a vertically extending resilient leg 166 provided at its top with an outwardly directed horizontal tab 167 having an opening 168, and at its bottom with an inwardly directed latching tongue 169. Upper tab 167 is secured to the underface of right hand frame side leg 149 by a screw engaging openings 168 and 152, and latch tongue transversely slidably engages slot 144 and is biased towards an advance position therein under the influence of spring arm 166. Tongue 169 releasably engages a selected notch 164 to lock releasably the socket member carrying carriage in a vertically adjusted position. To adjust the vertical position of the socket member, latch tongue 169 is manually withdrawn from a respective notch 164 against the influence of spring arm 166 and carriage 154 is raised or lowered to bring another notch into registry with slot 144 to permit the tongue to advance under the influence of spring arm 166 into engagement with the registering notch.

Except as explained above, the construction and operation of the embodiment last described are similar to those of the embodiment first described.

While there has been described and illustrated preferred embodiments of the present invention, it is apparent that numerous alterations and additions and omissions may be made without departing from the spirit thereof.

I claim:

1. A recessed light fixture comprising a transversely extending upper first reflector member having longitudinally extending side borders, a reflector assembly including a pair of longitudinally and vertically extending transversely spaced second reflector members terminating in transversely extending flanges, said first and second reflector members defining a lamp cavity having a light emitting opening, support means in said lamp cavity for supporting at least a lamp below said first reflector and between said second reflector members, means positioning said first and second reflector members with the flanges of said second reflector member located below and extending along the borders of said first reflector member and in spaced relationship to said first reflector member to define air flow passageways between said flanges and borders, said passageways having an entrance communicating with said lamp cavity and an exit communicating with the surrounding area, whereby air flows into said lamp cavity through said light emitting opening, around the lamp and through the passage from entrance to exit to be dissipated in the surrounding area.

2. The light fixture of claim 1 wherein said positioning means includes projections extending from one of the confronting faces of the borders of said first reflector members to the second reflector member flanges.

3. The light fixture of claim 1 wherein said first reflector member includes longitudinal flanges depending from the side edges of said first reflector member and spaced outwardly from the outer edge of the flanges of said second reflector member.

4. The light fixture of claim 1 comprising a plurality of longitudinally spaced saddle shaped brackets each including a transversely extending cross member and depending side legs, means securing said first reflector member to said bracket cross member, and means releasably securing said first reflector member and said reflector assembly including latch springs secured to opposite sides of said bracket cross member, and having first end portions depending therefrom below said first reflector member and having inwardly extending shoulders engaging the underside of said second reflector member flanges.

5. The light fixture of claim 4 wherein each of said brackets cross members includes an upper medial cross arm, vertically extending side arms depending from the ends of said side arms and terminating in outwardly horizontally projecting members, and said first reflector securing means includes a longitudinally extending inverted channel shaped housing, means securing said housing in the space delineated by said bracket cross arms and depending side arms, and means securing said first reflector member to said housing.

6. The light fixture of claim 5 wherein said housing includes upper flanges and the means to secure said housing include second end portions of said reflector assembly latch springs opposite said first portions thereof projecting through said bracket cross member depending arms and having upwardly facing shoulders engaging said housing flanges.

7. The light fixture of claim 4 wherein said positioning means comprises bumps integrally formed with and depending from the side borders of said first reflector member and engaging the upper faces of said second reflector member flanges.

8. The light fixture of claim 4 including at least one elongated flexible member connected between a bracket depending side leg and said reflector assembly.

9. The light fixture of claim 4 wherein said second light reflectors are upwardly inwardly curved and terminate at their bottoms in outwardly directed flanges and said reflector assembly includes vertical baffles extending transversely between and secured to the lower portions of said second reflector members.

10. A dropped ceiling recessed light fixture system including a pair of transversely spaced longitudinally extending beams, a plurality of longitudinally spaced saddle shaped brackets extending transversely between said beams and having an upper cross member disposed above said beams, and depending side legs with their lower portions engaging respective beams, means for releasably locking said side legs to said beams against upward movement relative thereto, a reflector assembly including longitudinally extending transversely spaced side reflector members and light baffles extending between and supported by the lower portions of said side reflector members, means mounted on the upper part of each of said brackets for releasably engaging the upper parts of said side baffles for releasably supporting said baffle assemblies in a raised position between said bracket side legs, and means for supporting a lamp between said baffles and bracket cross members.

11. The system of claim 10 wherein each of said beams is of inverted T-shaped transverse cross-section, and includes a medial vertical leg with longitudinally spaced coupling openings and a bottom cross leg, and each bracket leg rests on the inner section of a respective beam cross leg and includes an outwardly offset vertically extending tongue projecting through a respective coupling opening.

12. The system of claim 10 wherein the upper part of the vertical leg of each beam is transversely enlarged, and said means for releasably locking said side legs to said beams includes a spring member anchored at its upper portion to a respective leg and having an inwardly projecting upwardly directed shoulder at its lower portion resiliently urged into engagement with the underface of said beam medial leg enlarged portion.

13. The system of claim 12 including an upper longitudinally and transversely extending reflector member located proximate said bracket cross members, the upper edges of said side reflector member extending to proximate the borders of said upper reflector member.

14. The system of claim 13 wherein said upper reflector member terminates in depending side flanges, and said side reflector members terminate at their tops in outwardly directed flanges parallel to and spaced below the side borders of said upper reflector member, and terminating inwardly of said depending side flanges.

15. The system of claim 12 wherein each of said bracket cross members includes a medial upper cross arm provided at its sides with depending side arm members from the outer ends of which depend said bracket side legs, and further comprising an inverted channel shaped housing extending between said brackets and located between said bracket depending side arms adjacent to said medial arms and means releasably locking said housing to said brackets.

16. The system of claim 15 including a transversely extending upper reflector member secured to the bottom of said housing and extending along the length thereof and having side borders proximate said bracket cross member outwardly directed side arms.

17. The system of claim 16 wherein said upper reflector member terminates in depending side flanges and has depending projections along its side borders and said side reflector members are provided with upper transversely extending side flanges engaging said projections and spaced thereby from said side borders, said side flanges terminating short of said depending flanges.

18. The system of claim 17 wherein said housing includes outer shoulders and said baffle supporting and housing locking means comprises an elongated spring member secured to each of said bracket cross members, outwardly directed side arms one end of each spring member defining said baffle assembly supporting means releasably resiliently engaging a respective side reflector member upper flange, and the other end of each spring member defining said housing locking means resiliently releasably engaging a respective housing shoulder.

19. The system of claim 15 wherein said lamp supporting means comprises an end plate secured to and depending from each end of said housing, and a fluorescent lamp socket member mounted on each end plate below said housing.

20. The system of claim 19 wherein each of said sockets is vertically adjustable relative to said housing.

21. A recessed light fixture comprising a longitudinally extending reflector wall assembly including upper and side interior reflector faces delineating an interior space and a bottom opening, means defining a sound attenuating narrow elongated air flow passageway from said interior space to the exterior thereof through said wall assembly and extending along the length of said wall assembly, and means for supporting a lamp within said interior space.

22. The fixture of claim 21 wherein said passageway is tortuous transversely of the length thereof.

23. The fixture of claim 21 wherein said assembly comprises a top wall and longitudinally extending side walls, said side walls terminating at their tops in flanges confronting and substantially parallel to and spaced from the side borders of said top wall to define said passageway therewith.

24. The fixture of claim 23 wherein said top wall terminates in depending side flanges spaced from the outer edges of said side wall flanges.

25. The light fixture of claim 1, wherein said positioning means includes projections extending downwardly from the flange of said first reflector member and bearing against the borders of said second reflector member, and spacing apart the flanges and borders.

26. The light fixture of claim 4, wherein said positioning means comprises a plurality of spaced bumpings integrally formed with and extending downwardly from the lower faces of the flanges of said first reflector member bearing against and spacing the side borders of said second reflector member.

* * * * *